US006474424B1

(12) United States Patent
Saxman

(10) Patent No.: US 6,474,424 B1
(45) **Date of Patent: *Nov. 5, 2002**

(54) ROTARY CONE DRILL BIT WITH IMPROVED BEARING SYSTEM

(75) Inventor: William C. Saxman, Cedar Hill, TX (US)

(73) Assignee: Halliburton Energy Services, Inc., Carrollton, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/324,950

(22) Filed: Jun. 3, 1999

Related U.S. Application Data

(63) Continuation of application No. PCT/US99/06876, filed on Mar. 25, 1999.
(60) Provisional application No. 60/079,554, filed on Mar. 26, 1998.

(51) Int. Cl.[7] ..... E21B 10/22
(52) U.S. Cl. ..... 175/371; 175/367
(58) Field of Search ..... 175/327, 331, 175/371, 372, 367, 368, 369, 370; 384/92, 96, 126

(56) References Cited

U.S. PATENT DOCUMENTS 1,779,487 A * 10/1930 Childs ..... 175/371
1,847,981 A * 3/1932 Reed ..... 175/369
2,214,221 A 9/1940 Catland
2,283,312 A * 5/1942 Boice ..... 175/372
2,339,161 A 1/1944 Fermier
3,449,024 A * 6/1969 Lichte ..... 175/371
3,476,446 A 11/1969 Neilson (List continued on next page.)

FOREIGN PATENT DOCUMENTS

SU 1406330 * 6/1988 ..... 175/371

OTHER PUBLICATIONS

"Roller Bits", Sandvik Coromant Rock Drilling Tools User's Handbook, *Sandvik Rock Tools*, HR–12820–ENG, 1994.

"Baker Hughes Mining Tools Product Catalog", *Baker Hughes Mining Tools* copyright 1991.

*Primary Examiner*—Heather Shackelford
*Assistant Examiner*—John Kreck

(57) ABSTRACT

A rotary cone drill bit for forming a borehole having a bit body with an upper portion adapted for connection to a drill string. A number of support arms extending from the bit body with each support arm having an exterior surface with an opening extending therethrough. A number of cutter cone assemblies equal to the number of support arms with each cutter cone assembly rotatably mounted on a respective spindle projecting generally downwardly and inwardly from each support arm. A ball retainer passageway extending from the opening in the exterior surface of each support arm to allow installing ball bearings through the opening and the ball retainer passageway to rotatably mount each cutter cone assembly on its respective spindle. A ball race formed in the exterior of each spindle between a first outside diameter portion and a second outside diameter portion. The ball retainer passageway intersecting the ball race. The first outside diameter portion and the second outside diameter portion providing portions of radial baring for rotatably mounting each cutter cone assembly on its respective spindle. The first outside diameter portion and the second outside diameter portion having approximately the same diameter relative to an axis extending through the spindle.

17 Claims, 4 Drawing Sheets

U.S. PATENT DOCUMENTS 3,823,030 A 7/1974 Hudson
3,866,987 A 2/1975 Estes
3,917,361 A 11/1975 Murdoch
3,952,815 A 4/1976 Dysart ..... 175/374
4,054,772 A 10/1977 Lichte ..... 219/121.14
4,056,153 A 11/1977 Miglierini ..... 175/376
4,120,543 A 10/1978 Greene, Jr. et al.
4,193,464 A * 3/1980 Dixon ..... 175/364
4,194,794 A 3/1980 Kling
4,235,480 A * 11/1980 Olschewski et al. ..... 384/94
4,280,571 A 7/1981 Fuller ..... 175/337
4,304,444 A 12/1981 Peterson
4,730,681 A 3/1988 Estes
4,874,047 A * 10/1989 Hixon ..... 175/369
4,955,440 A * 9/1990 Chavez ..... 175/371
5,016,719 A * 5/1991 White ..... 175/353
5,362,073 A * 11/1994 Upton et al. ..... 277/92
5,439,068 A 8/1995 Huffstutler et al.
5,513,713 A 5/1996 Groves ..... 175/73
5,547,033 A * 8/1996 Campos, Jr. ..... 175/331
5,553,681 A 9/1996 Huffstutler et al.
5,570,750 A 11/1996 Williams
5,593,231 A 1/1997 Ippolito ..... 384/114
5,439,067 A 3/1997 Huffstutler
5,695,019 A 12/1997 Shamburger, Jr.
5,709,278 A 1/1998 Crawford

* cited by examiner

ROTARY CONE DRILL BIT WITH IMPROVED BEARING SYSTEM

This application is a continuation of copending application PCT/US99/06876 filed Mar. 25, 1999, which claims priority from U.S. provisional application 60/079,554, filed Mar. 26, 1998.

TECHNICAL FIELD OF THE INVENTION

The present invention relates generally to a rotary cone drill bit having multiple support arms with a spindle or journal extending from each support arm and a ball retaining system for rotatably mounting a respective cutter cone assembly thereon and more particularly an improved bearing system to increase downhole drilling performance of the associated drill bit.

BACKGROUND OF THE INVENTION

Various types of rotary drill bits or rock bits may be used to form a borehole in the earth. Examples of such rock bits include roller cone drill bits or rotary cone drill bits used in drilling oil and gas wells. A typical roller cone drill bit includes a bit body with an upper portion adapted for connection to a drill string. A plurality of support arms, typically three, depends from the lower portion of the bit body with each support arm having a spindle or journal protruding radially inward and downward with respect to a projected axis of rotation of the bit body.

Conventional roller cone drill bits are typically constructed in three segments. The segments may be positioned together longitudinally with a welding groove between each segment. The segments may then be welded with each other using conventional techniques to form the bit body. Each segment also includes as associated support arm extending from the bit body. As enlarged cavity or passageway is typically formed in the bit body to receive drilling fluids from the drill string. U.S. Pat. No. 4,054,772 entitled Positioning System for Rock Bit Welding, shows a method and apparatus for constructing a three-cone rotary rock bit from three individual segments.

A cutter cone assembly is generally rotatably mounted on a respective spindle or journal. The cutter cone assembly typically has a cavity formed therein and sized to receive the respective spindle. Various types of bearings and/or bearing surfaces may be disposed or found between the exterior of the spindle and the interior of the cavity. A typical bearing system used to rotatably mount a cutter cone assembly on a spindle will include one or more radial bearings and one or more thrust bearings. The radial bearings will generally be located between the outside diameter of the spindle and interior surfaces of the cavity disposed adjacent thereto. Thrust bearings and/or thrust bearing surfaces will generally be located between the end of the spindle opposite from the associated support arm and adjacent portions of the cavity formed in the cutter cone assembly. For some applications, a shoulder may be formed on the exterior of the spindle and a corresponding shoulder formed on the interior of the cavity with a thrust bearing and/or thrust bearing surfaces disposed therebetween.

The thrust bearings and/or the radial bearings may be formed as integral components of the spindle such as shown in U.S. Pat. No. 3,823,033 entitled Method for Making a Bearing System Having in Trained Wear-Resistant Particles. For some applications, roller type bearings may be disposed between the outside diameter of the spindle and adjacent portions of the cavity to support radial loads transmitted from the cutter cone assembly to the spindle. An example of such roller type bearings is shown in U.S. Pat. No. 3,952,815 entitled Land Krosion Protection for a Rock Cutter. U.S. Pat. No. 5,513,713 entitled Sealed and Lubricated Rotary Cone Drill Bit Having Improved Seal Protection shows multiple sets of roller type bearings disposed between a spindle and adjacent portions of a cavity. For other applications, a bushing may be disposed between the outside diameter of the spindle and adjacent portions of the cavity to carry such radial loads. Examples of such bushings are shown in U.S. Pat. No. 5,570,750 entitled Rotary Drill Bit With Improved Shirttail and Seal Protection and U.S. Pat. No. 5,593,231 entitled Hydrodynamic Bearings. These patents also disclose examples of thrust buttons or thrust bearings which may be disposed between the end of the spindle and adjacent portions of the cavity.

In a sealed rotary cone drill bit, lubricant under pressure is forced into a space formed between the exterior of the spindle and the interior of the cavity to cool and protect associated bearings and/or bearing surfaces. A lubricant reservoir is generally provided to compensate for any partial loss of lubricant and to balance internal lubricant pressure with external hydrostatic pressure during downhole drilling operation. The lubricant may comprise, for example, a calcium complex grease. Additionally, solids, such as molybdenum disulfide, may be added to the lubricant to increase the load carrying capacity of the bearings and/or bearing surfaces.

Bearings and bearing surfaces in a typical rotary cone drill bit are heavily loaded during downhole drilling operations. During such drilling operations, the drill bit is rotated in a borehole which causes the associate cutter cone assemblies to rotate on their respective spindles. The drill bit typically operates at a low speed with heavy weight applied to the bit which also produces a high load on the associated bearings. Rotary cone drill bits with sealed lubrication systems typically include one or more elastomeric seals which may be damaged from exposure to high temperatures created by excessive friction due to such heavy loads. Also, non-concentric rotation and/or wobbling of a cutter cone assembly on its respective spindle is another possible cause of seal damage. Seal failure from exposure to high temperatures or mechanical damage will eventually allow water, drilling fluids, and other debris from the drilling operation to penetrate the space between the cavity in the cutter cone assembly and the associated spindle and increase wear on the bearings and/or bearing surfaces to the point the cutter cone assemblies may be lost in the borehole.

U.S. Pat. No. 4,056,153 entitled Rotary Rock Bit with Multiple Row Coverage for Very Hard Formations, and U.S. Pat. No. 4,280,571 entitled Rock Bit, show examples of conventional rotary cone bits with cutter cone assemblies mounted on a spindle projecting from a support arm. Typically, ball bearings are inserted through an opening in an exterior surface of each support arm and a ball retainer passageway extending therefrom to rotatably secure each cutter cone assembly on its respective spindle. A ball retainer plug is then inserted into the ball retainer passageway. Finally, a ball plug weld is generally formed in the opening to secure the ball retainer plug within the ball retainer passageway.

Hardfacing of metal surfaces and substrates is a well-known technique to minimize or prevent erosion and abrasion of the metal surface or substrate. Hardfacing can be generally defined as applying a layer of hard, abrasion resistant material to a less resistant surface or substrate by plating, welding, spraying or other well known metal deposition techniques. Hardfacing is frequently used to extend the service life of drill bits and other downhole tools used in the oil and gas industry. Tungsten carbide and its various alloys are some of the more widely used hardfacing materials to protect drill bits and other downhole tools associated with drilling and producing oil and gas wells.

SUMMARY OF THE INVENTION

In accordance with teachings of the present invention, disadvantages and problems associated with previous rotary cone drill bits have been substantially reduced or eliminated. One aspect of the present invention includes providing a rotary cone drill bit having support arms and a spindle or journal extending from each support arm with a respective cutter cone assembly rotatably mounted thereon. The location of the mechanism which retains each cutter cone assembly on its respective spindle, such as ball bearings disposed between the exterior of the spindle and the interior of a cavity formed in each cutter cone assembly, is optimized to increase the effectiveness of both radial bearing components and thrust bearing components of the associated bearing system. For example, an exterior portion of each spindle may have a generally uniform outside diameter with a first radial bearing or bearing surface and a second radial bearing or bearing surface disposed thereon with a ball race formed in the exterior of the spindle between the first radial bearing and the second radial bearing. Dimensions of the first radial bearing relative to the second radial bearing may be selected in accordance with teachings of the present invention to increase load carrying capability of the associated bearing system and ability of the bearing system to prevent non-concentric rotation and/or wobble of the cutter cone assembly relative to its respective spindle. Teachings of the present invention may be used with a wide variety of mechanisms which hold a cutter cone assembly on a spindle in addition to ball bearings.

Technical benefits of the present invention include providing a rotary cone drill bit having a bearing system with increased load carrying capability which may be incorporated into existing support arm and cutter cone assemblies without substantially increasing or modifying the overall configuration of the support arm and cutter cone assembly. A bearing system incorporating teachings of the present invention generally maintains more concentric alignment during rotation of a cutter cone assembly onto its respective spindle and minimizes any tendency of the cutter cone assembly to wobble relative to the spindle. The present invention will prolong the downhole life of an associated rotary cone drill bit by increasing the load carrying capability of both radial bearing components and thrust bearing components of the associated bearing system. The present invention also provides a rotary cone drill bit in which the configuration and dimensions of the shirttail portion of each support arm may be increased to prolong the downhole life of the associated rotary cone drill bit.

Technical advantages of the present invention include the ability to apply hardfacing material on an enlarged shirttail portion of each support arm. Alternatively, the present invention allows increasing the number and/or size of inserts and compacts which may be installed within the shirttail portion of each support arm. Increasing the size of the shirttail portion of a support arm and covering the enlarged shirttail portion with a layer of hardfacing in accordance with teachings of the present invention may be particularly effective in increasing drill bit life during drilling of horizontal and/or directional well bores. Premature drill bit failure due to increased side loading of the associated drill and increased abrasion, erosion, and/or wear of the support arms may occur under such conditions. Multiple inserts and compacts may also be more securely installed within the shirttail portion of each support arm adjacent to the ball plug hole to further enhance abrasion, erosion and/or wear resistance.

Other technical advantages will be readily apparent to one skilled in the art from the following figures, descriptions, and claims.

BRIEF DESCRIPTION OF THE DRAWINGS

For a more complete understanding of the present invention and its advantages, reference is now made to the following brief description, taken in conjunction with the accompanying drawings and detailed description, wherein like reference numerals represent like parts, in which.

DETAILED DESCRIPTION OF THE INVENTION

The preferred embodiments of the present invention and its advantages are best understood by referring now in more detail to FIGS. 1–6 of the drawings, in which like numerals refer to like parts.

Support arms and cutter cone assemblies incorporating teachings of the present invention may be used with a wide variety of rotary cone drill bits. Rotary cone drill bits 20, 70 and 170 which will be discussed later in more detail represent only a few examples of the many types of drill bits which may have a bearing system incorporating teachings of the present invention. The support arms and cutter cone assemblies which are shown in FIGS. 1–6 will be described with respect to a sealed lubrication system. However, a bearing system incorporating teachings of the present invention may be satisfactorily used with air cooled drill bits and drill bits which do not have a lubrication system.

Figure 1:
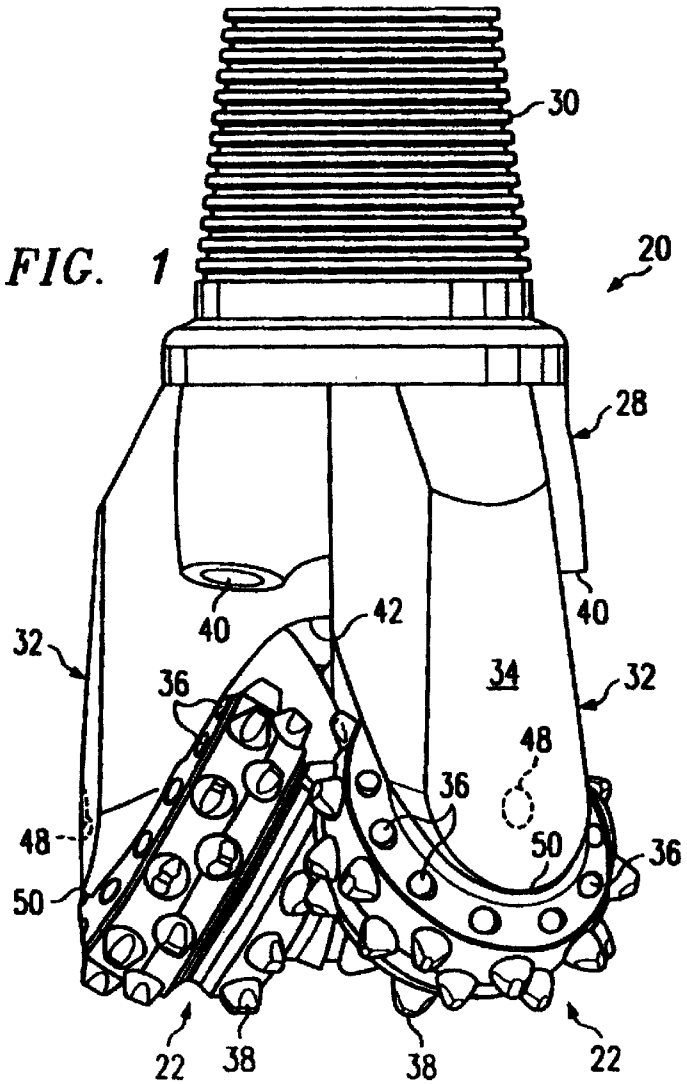
FIG. 1 is a schematic drawing in elevation showing one type of rotary cone drill bit with support arms and cutter cone assemblies formed in accordance with teachings of the present invention.

FIG. 1 illustrates various aspects of a rotary cone drill bit indicated generally at 20 of the type used in drilling a borehole in the earth. Drill bit 20 may also be referred to as a "roller cone rock bit" or "rotary rock bit." With rotary cone drill bit 20, cutting action occurs as cone-shaped cutters, indicated generally at 22, are rolled around the bottom of a borehole (not expressly shown) by the rotation of a drill string (not expressly shown) attached to drill bit 20. Cutter cone assemblies 22 may also be referred to as "rotary cone cutters" or "roller cone cutters." Each cutter cone assembly 22 is rotatably mounted on a respective journal or spindle (not expressly shown) with a bearing system incorporating teachings of the present invention disposed therebetween. Examples of such bearing systems are shown in FIGS. 3, 4, 5 and 6.

Rotary cone drill bit 20 includes bit body 28 having a tapered, externally threaded upper portion 30 which is adapted to be secured to the lower end of a drill string. Depending from body 28 are three support arms 32. Only two support arms 32 are visible in FIG. 1. Each support arm 32 preferably includes a spindle or journal formed integral with the respective support arm 32. Each cutter cone assembly 22 is rotatably mounted on a respective spindle. The spindles are preferably angled downwardly and inwardly with respect to bit body 28 and exterior surface 34 of the respective support arm 32. As drill bit 20 is rotated, cutter cone assemblies 22 engage the bottom of a borehole (not expressly shown). For some applications, the spindles may also be tilted at an angle of zero to three or four degrees in the direction of rotation of drill bit 20.

Cutter cone assemblies 22 may include surface compacts or inserts 36 pressed into respective gage surfaces and protruding inserts 38 or milled teeth (not expressly shown), which scrape and gouge against the sides and bottom of the borehole under the downhole force applied through the associated drill string. The formation of borehole debris created by cutter cone assemblies 23 is carried away from the bottom of the borehole by drilling fluid flowing from nozzles 40 adjacent to lower portion 42 of bit body 28. The drilling fluid flow upwardly toward the surface through an annulus (not expressly shown) formed between drill bit 20 and the side wall (not expressly shown) of the borehole.

Each cutter cone assembly 22 is generally constructed and mounted on its associated journal or spindle in a substantially identical manner. Dotted circle 48 on exterior surface 34 of each support arm 32 represents an opening to an associated ball retainer passageway (not expressly shown). The function of opening 48 and the associated ball retainer passageway will be discussed later with respect to rotatably mounting cutter cone assemblies on their respective spindle. One of the benefits of the present invention includes increasing the distance or spacing between each opening 48 and shirttail 50 of the respective support arm 32.

Figure 2:
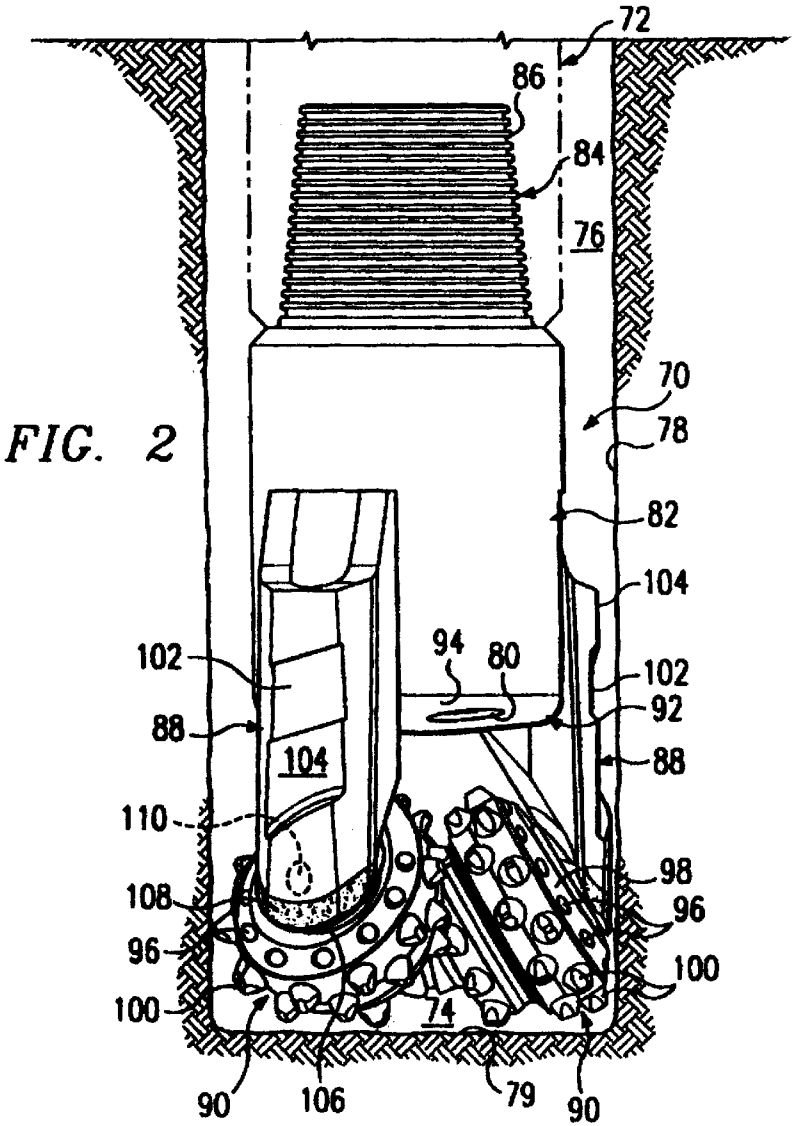
FIG. 2 is a schematic drawings in section and in elevation with portions broken away showing another type of rotary cone drill bit disposed at a downhole location in a borehole with the drill bit having support arms and cutter cone assemblies formed in accordance with teachings of the present invention.

FIG. 2 is an isometric drawing of a rotary cone drill bit indicated generally at 70 constructed according to teachings of the present invention attached to drill string 72 and disposed in borehole 74. Example of such drill bits and their associated bit body, support arms and cutter cone assemblies are shown in U.S. Pat. No. 5,439,067 entitled Rock Bit With Enhanced Fluid Return Area, and U.S. Pat. No. 5,439,068 entitled Modular Rotary Drill Bit. These patents provide additional information concerning the manufacture and assembly of unitary bit bodies, support arms and cutter cone assemblies which are satisfactory for use with the present invention.

Annulus 76 is formed between the exterior of drill string 72 and the interior or wall 78 of borehole 74. In addition to rotating drill bit 70, drill string 72 is often used to provide a conduit for communicating drilling fluids and other fluids from the well surface to drill bit 70 at the bottom of borehole 74. Such drilling fluids may be directed to flow from drill string 72 to multiple nozzles 80 provided in drill bit 70. Cuttings formed by drill bit 70 and any other debris at the bottom of borehole 74 will mix with drilling fluids exiting from nozzles 80 and returned to the well surface via annulus 76.

Drill bit 70 includes one piece or unitary body 82 with upper portion 84 having a threaded connection or pin 86 adapted to secure drill bit 70 with the lower end of drill string 72. Three support arms 88 are preferably attached to end extend longitudinally from bit body 82 opposite from pin 86. Only two support arms 88 are shown in FIG. 2. Each support arm 88 preferably includes a respective cutter cone assembly 90. Cutter cone assemblies 90 extend generally downwardly and inwardly from respective support arms 88.

Bit body 82 includes lower portion 92 having a generally convex exterior surface 94 formed thereon. The dimensions of convex surface 94 and the location of cutter cone assemblies 90 are selected to optimize fluid flow between lower portion 92 of bit body 82 and cutter cone assemblies 90. The location of each cutter cone assembly 90 relative to lower portion 92 may be varied by adjusting the length of support arms 88 and the spacing of support arms 88 on the exterior of bit body 82.

Cutter cone assemblies 90 may further include a plurality of surface compacts 96 disposed in gauge face surface 98 of each cutter cone assembly 90. Each cutter cone assembly 90 may also include a number of projecting inserts 100. Surface compacts 96 and inserts 100 may be formed from various types of hard materials depending on anticipated downhole operating conditions. Alternatively, milled teeth (not expressly shown) may be formed as an integral part of each cutter cone assembly 90.

Each support arm 88 also comprises flow channel 102 to aid removal of cuttings and other debris from borehole 74. Flow channel 102 is disposed on exterior surface 104 of support arm 88. Flow channel 102 may be formed in each support arm 88 by a machining operation. Flow channel 102 may also be formed during the process of forging the respective support arm 88. After support arms 88 has been forged, flow channels 102 may be further machined to define their desired configuration.

Each support arm 88 includes shirttail 106 with a layer of selected hardfacing materials covering shirttail portion 108. Alternatively, one or more compacts or inserts (not expressly shown) may be disposed within shirttail portion 108. As a result of combining a bearing system incorporating teachings of the present invention included with support arms 88 and cutter cone assemblies 90, the dimensions of associated shirttail portions 108 may be enlarged to better accommodate the use of compacts and/or inserts to protect shirttail portions 108 from abrasion, erosion and wear. As discussed later in more detail, the location of opening 110 and the associated ball retainer passageway may be modified to increase the dimensions of shirttail portion 108.

Figure 3:
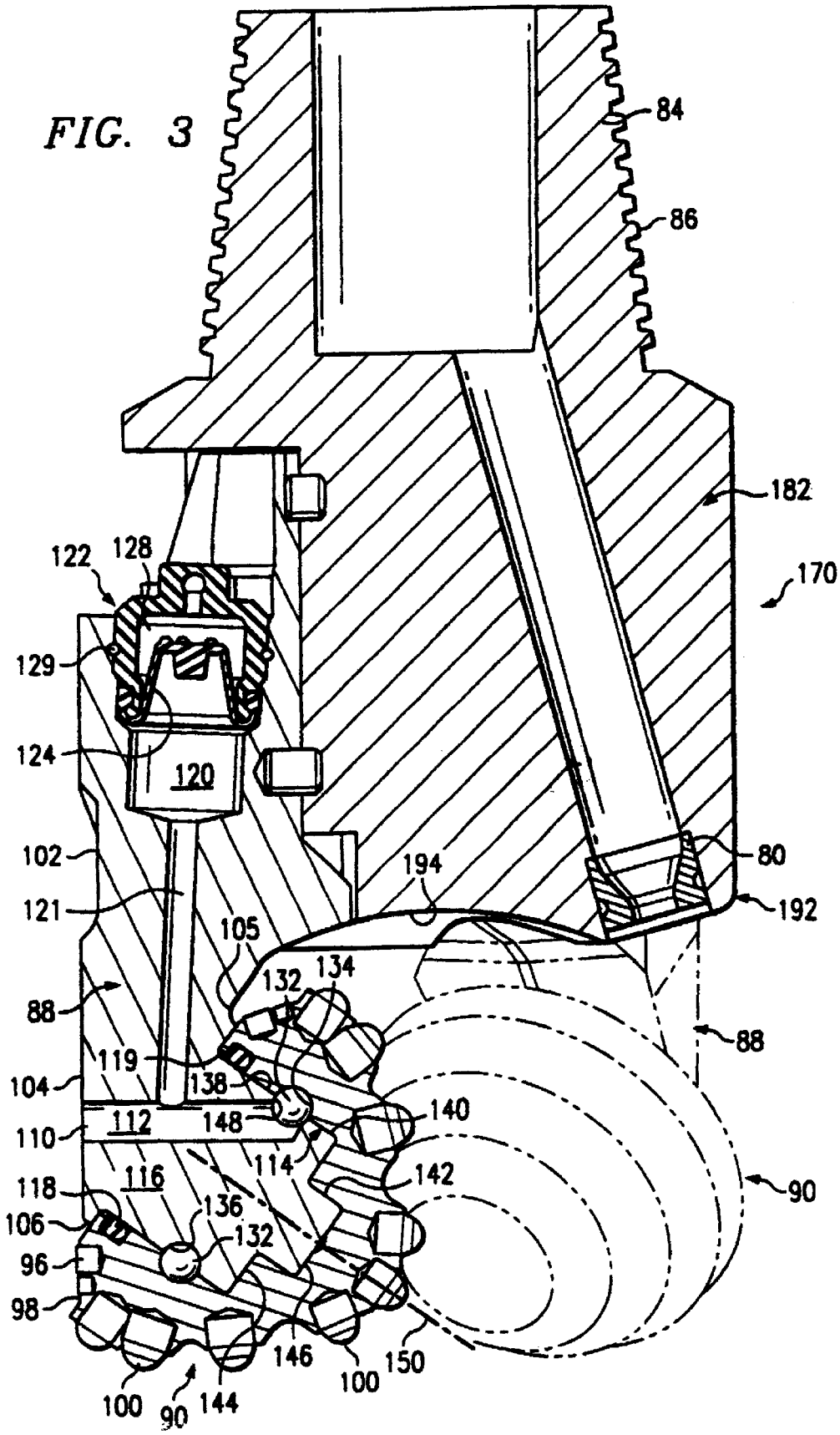
FIG. 3 is a schematic drawing in section and in elevation with portions broken away of a drill bit having a unitary bit body with support arms and cutter cone assemblies similar to the drill bit shown in FIG. 2.

FIG. 3 is a schematic drawing in sections with portions broken away showing rotary cone drill bit 170 with support arms 88 and cutter cone assemblies 90 having bearing systems incorporating various teachings of the present invention. Various components of the associated bearing systems, which will be discussed later in more detail, allow each cutter cone assembly 90 to be rotatably mounted on its respective journal 116. Rotary cone drill bit 170 includes one piece or unitary bit body 182. Bit body 182 is substantially similar to previously described bit body 82 except for lower portion 192 which has a generally concave exterior surface 194 formed thereon. The dimensions of concave surface 194 and the location of cutter cone assemblies 90 may be selected to optimize fluid flow between lower portion 192 of bit body 182 and cutter cone assemblies 90 as previously described with respect to bit body 82.

Cutter cone assemblies 22 of drill bit 20 may be mounted on a journal or spindle projecting from respective support arms 32 using substantially the same techniques associated with mounting cutter cone assemblies 90 on spindle or journal 116 projecting from respective support arms 88. Also, a bearing system incorporating teachings of the present invention may be satisfactorily used to rotatably mount cutter cone assemblies 22 on respective support arms 32 in substantially the same manner as used to rotatably mount cutter cone assemblies 90 on respective support arms 88. Therefore, the various features and benefits of the present invention will be described primarily with respect to support arms 88 and cutter cone assemblies 90.

Each cutter cone assembly 90 preferably includes generally cylindrical cavity 114 which has been sized to receive spindle or journal 116 therein. Each cutter cone assembly 90 and its respective spindle 116 has a common longitudinal axis 150 which also represents the axis of rotation for cutter cone assembly 90 relative to its associated spindle 116. Various components of the respective bearing system include machined surfaces associated with the interior of cavity 114 and the exterior of spindle 116. These machined surfaces will generally be described with respect to axis 150.

The support arms and cutter cone assemblies shown in FIGS. 3, 4, 5, and 6 preferably include a sealed lubrication system. As previously noted, bearing systems incorporating teachings of the present invention may be satisfactorily used with support arms and cutter cone assemblies which are air cooled or which do not include a lubrication system. For the embodiments of the present invention as shown in FIGS. 3, 4, 5 and 6, seal ring 118 is located at mouth or opening 119 of cavity 114 to establish a fluid barrier between cavity 114 and journal 116. Seal ring 118 may be formed from various types of elastomeric material to provide a substantially fluid tight seal.

For the embodiments shown in FIGS. 3, 4, 5 and 6, each cutter cone assembly is retained on its respective journal by a plurality of ball bearings 132. However, a wide variety of cutter cone assembly retaining mechanisms which are well known in the art, may also be used with a bearing system incorporating teachings of the present invention. For the example shown in FIG. 3, ball bearings 132 are inserted through opening 110 in exterior surface 104 and ball retainer passageway 112 of the associated support arm 88. Ball races 134 and 136 are formed respectively in the interior of cavity 114 of the associated cutter cone assembly 90 and the exterior of journal 116.

Ball retainer passageway 112 is connected with ball races 134 and 136 such that ball bearings 132 may be inserted therethrough to form an annular array within ball races 134 and 136 to prevent disengagement of cutter cone assembly 90 from its associated journal 116. Ball retainer passageway 112 is subsequently plugged by inserting a ball plug retainer (not expressly shown) therein. A ball plug weld (not expressly shown) is preferably formed within each opening 110 to provide a fluid barrier between ball retainer passageway 112 and the exterior of each support arm 88 to prevent contamination and/or loss of lubricant from the associated sealed lubrication system.

Each support arm 88 preferably includes lubricant cavity or lubricant reservoir 120 having a generally cylindrical configuration. Lubricant cap 122 is disposed within one end of lubricant cavity 120 to prevent undesired fluid communication between lubricant cavity 120 and the exterior of support arm 88. Lubricant cap 122 includes flexible, resilient diaphragm 124 that closes lubricant cavity 120. Cap 122 converse diaphragm 124 and defines in part chamber 120 facing diaphragm 124 to provide a volume into which diaphragm 124 can expand. Cap 122 and diaphragm 124 retained within lubricant cavity 120 by retainer 129.

Lubricant passage 121 extends through support arm 88 to place lubricant cavity 120 in fluid communication with ball retainer passageway 112. Ball retainer passageway 112 provides fluid communication with internal cavity 114 of the associated cutter cone assembly 90 and the bearing system disposed between the exterior of spindle 116 and the interior of cavity 114. Upon assembly of drill bit 170, lubricant passage 121, lubricant cavity 120, any available space in ball retainer passageway 112, and any available space between the interior surface of cavity 114 and the exterior of spindle 116 are filled with lubricant through on opening (not expressly shown) in each support arm 88. The opening is subsequently sealed after lubricant filling.

The pressure of the external fluids outside drill bit 170 may be transmitted to lubricant (not expressly shown) contained in lubricant cavity 120 by diaphragm 124. The flexing of diaphragm 124 maintains the lubricant at a pressure generally equal to the pressure of external fluids outside drill bit 170. This pressure is transmitted through lubricant passage 121, ball retainer passageway 112 and internal cavity 114 to expose the inward face of seal ring 118 to pressure generally equal to the pressure of the external fluids.

Each spindle or journal 116 is formed on inside surface 105 of each support arm 88. Each spindle 116 has a generally cylindrical configuration extending along axis 150 from support arm 88. Axis 150 also corresponds with the axis of rotation for the associated cutter cone assembly 90. For the embodiment of the present invention as shown in FIG. 3, spindle 116 includes first outside diameter portion 138, second outside diameter portion 140, and third outside diameter portion 142.

First outside diameter portion 138 extends from the junction between spindle 116 and inside surface 105 of support arm 88 to ball race 136. Second outside diameter portion 140 extends from ball race 136 to shoulder 144 formed by the change in diameter from second diameter portion 140 and third diameter portion 142. First outside diameter portion 138 and second outside diameter portion 140 have approximately the same diameter measured relative to the axis 150. Third outside diameter portion 142 has a substantially reduced outside diameter in comparison with first outside diameter portion 138 and second outside diameter portion 140. Cavity 114 of cutter cone assembly 90 preferably includes machined surface corresponding generally with first outside diameter portion 138, second outside diameter portion 140, third outside diameter portion 142, shoulder 144 and end 146 of spindle 116.

As discussed later in more detail, first outside diameter portion 138, second outside diameter portion 140, third outside diameter portion 142 and corresponding machined surfaces formed in cavity 114 provide one or more radial bearing components used to rotatably support cutter cone assembly 90 on spindle 116. Shoulder 144 and end 146 of spindle 116 and corresponding machined surfaces formed in cavity 114 provide one or more thrust bearing components used to rotatably support cutter cone assembly 90 on spindle 116. As discussed later in more detail, various types of bushings, roller bearings, thrust washers, and/or thrust buttons may be disposed between the exterior of spindle 116 and corresponding surfaces associated with cavity 114. Radial bearing components may also be referred to as journal bearing components.

As best shown in FIG. 3, ball retainer passageway 112 extends from opening 110 in exterior surface 104 of support arm 88 through spindle 116 and intersects with ball race 136. The intersection between ball retainer passageway 112 and ball race 136 forms opening 148 in the exterior of spindle 116. An important feature of the present invention includes positioning ball race 136 and opening 148 intermediate the junction between spindle 116 and interior surface 105 of support arm 88 and shoulder 144 formed on the exterior of spindle 116. As shown in FIGS. 3, 4, 5, and 6, selecting the location of ball race 136 and opening 148 in accordance with teachings of the present invention substantially increases the length of second outside diameter portion 140 as compared with previous support arm and cutter cone assemblies.

Depending on specific dimensions and configurations associated with drill bit 170, support arms 88, spindles 116 and cutter cone assemblies 90, the length of second outside diameter portion 140 may vary between approximately twenty-five percent (25%) of the length of first outside diameter portion 138 and approximately the same length as first outside diameter portion 138. For large diameter drill bits, the radii of the associated spindles will also increase. For such applications, the length of second outside diameter portion 140 may be greater than the length of first outside diameter portion 138. Varying the length associated with first outside diameter portion 138 and second outside diameter portion 140 in accordance with teachings of the present invention will enhance both the radial load carrying capability and the thrust load carrying capability of the bearing system used to rotatably mount cutter cone assembly 90 on spindle 116.

For the embodiment shown in FIG. 3, the dimensions associated with first outside diameter portion 138 and second outside diameter portion 130, and the dimensions of adjacent portions of cavity 114 are selected to provide radial bearing support during rotation of cutter cone assembly 90 on spindle 116. In a similar manner, the dimensions associated with first outside diameter 142 and adjacent portions of cavity 114 are selected to provide additional radial bearing support during rotation of cutter cone assembly 90 on spindle 116. First outside diameter portion 138 and second outside diameter portion 140 cooperate with each other to form the primary journal bearing or primary radial bearing associated with rotatably mounting cutter cone assembly 90 on spindle 116. Third outside diameter portion 142 provides a secondary journal bearing or secondary radial bearing.

The combined effective length of the bearing surfaces represented by first outside diameter portion 138 and second outside diameter portion 140 is approximately the same as the length of a primary journal bearing associated with previous spindles and cutter cone assemblies. However, by placing opening 148 from ball retainer passageway 112 between first outside diameter portion 138 and second outside diameter portion 140, the effective spread of the primary journal bearing or radial bearing is substantially increased as compared with previous spindles and cutter cone assemblies having approximately the same dimensions. Also, the increased length of second outside diameter portion 140 provides a relatively strong, robust shoulder 144 which will substantially increase the thrust load bearing capability as compared to a previous spindle/cutter cone assembly having only end 146 for carrying thrust loads.

Figure 4:
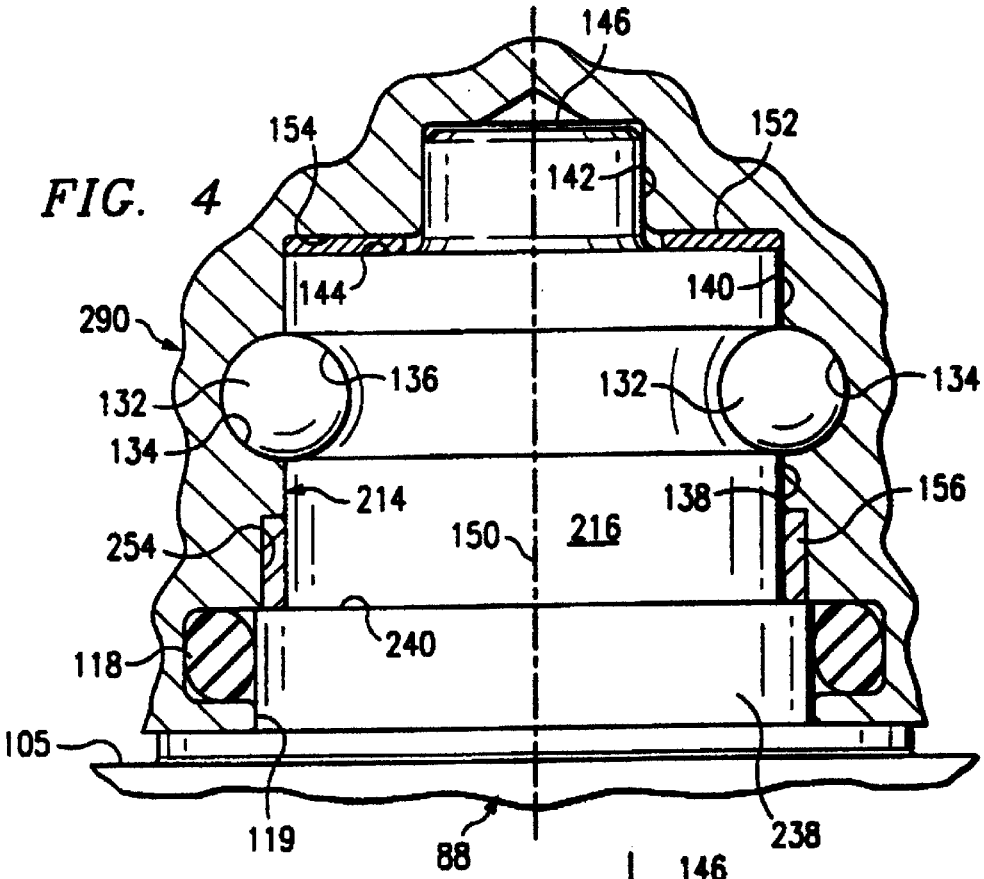
FIG. 4 is an enlarged schematic drawing in section and in elevation with portions broken away showing a bearing system incorporating teachings of the present invention in combination with a cutter cone assembly rotatably mounted on a spindle projecting from a support arm.
Figure 5:
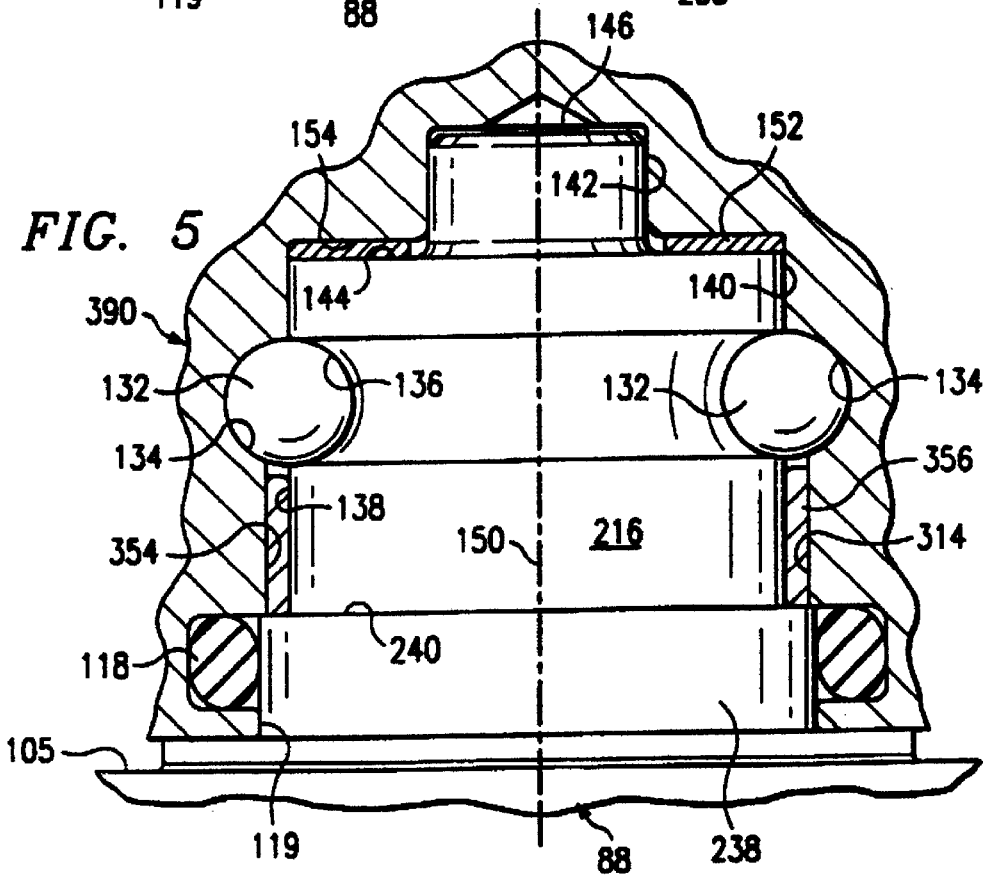
FIG. 5 is an enlarged schematic drawing in section and in elevation with portions broken away showing another bearing system incorporating teachings of the present invention in combination with a cutter cone assembly rotatably mounted on a spindle projecting from a support arm.
Figure 6:
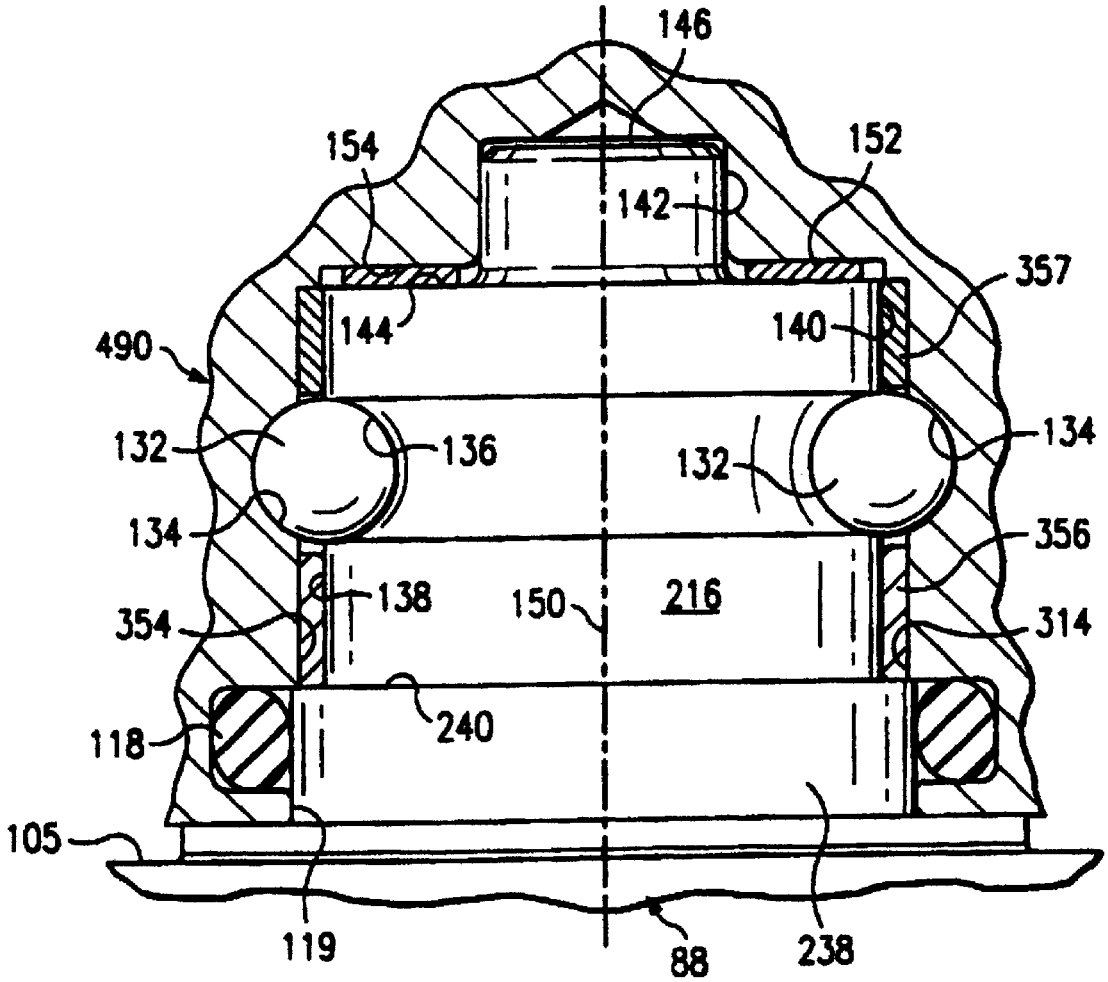
FIG. 6 is an enlarged schematic drawing in section and in elevation with portions broken away showing a further bearing system incorporating teachings of the present invention in combination with a cutter cone assembly rotatably mounted on a spindle projecting from a support arm.

As shown in FIGS. 4, 5, and 6, the present invention allows rotatably mounting a cutter cone assembly on a spindle having a bearing system with increased radial and/or thrust load carrying capacity without requiring a substantial increase in the physical boundaries associated with the bearing system. Cutter cone assembly 190 shown in FIG. 4 and cutter cone assembly 290 shown in FIG. 5 are substantially the same as previously described cutter cone assembly 90 except for modification of selected machined surfaces formed in respective cavities 214 and 314. Spindle 216 shown in FIGS. 4, 5 and 6 is substantially the same is previously described spindle 116 except for modifications formed on the outside diameter of spindle 216 adjacent to inside surface 105 of support arm 88.

For the embodiments of the present invention shown in FIGS. 4, 5 and 6, thrust washer 152 is preferably disposed between shoulder 144 on spindle 216 and corresponding shoulder 154 formed within cavities 214 and 314. The location of ball race 136 formed in the exterior of spindle 216 is preferably selected such that the length of second outside diameter portion 140 will provide relatively strong, robust support for shoulder 144 and thrust collar 152. Increasing the length of second outside diameter portion 140 increases the sheer strength associated with shoulder 144 which allows the associated rotary cone drill bit 170 to better withstand abusive downhole drilling conditions such as dropping drill string 72 in borehole 74. Also, increasing the length of second outside diameter 140 reduces the possibility of thermal and/or mechanical cracking which might occur if shoulder 144 was supported by a relatively thin section of metal.

For some applications, a thrust button (not expressly shown) may be disposed between end 146 of spindle 216 and adjacent portions of cavity 214 and 314. As a result of locating ball race 136 in the exterior of spindle 216 in accordance with teachings of the present invention, the thrust bearing components associated with roatably mounting cutter cone assemblies 290 and 390 on respective spindles 216 may be substantially increased as compared to previous rotary cone bits in which the ball race was generally formed closer to the end of the respective spindle associated support arm.

For some applications, radial bearings and/or thrust bearings of a bearing system incorporating teachings of the present invention may be formed as integral components of the spindle and/or cavity of the associated cutter cone assembly. Cutter cone assembly 90 and spindle 116 shown in FIG. 3 is a schematic representation of such a bearing system. The bearing system used to rotatably mount cutter cone assembly 290 on spindle 216 as shown in FIG. 4 includes thrust washers 152 and radial bushing 156. For this particular embodiment, interior cavity 214 includes an enlarged inside diameter portion which provides recess 254 sized to receive bushing 156 therein. Spindle 216 also includes an enlarged outside diameter portion 238 formed adjacent to inside surface 105 of support arm 88 to form a fluid barrier with seal ring 118. Enlarged outside diameter portion 238 also forms shoulder 240 which contacts bushing 156 to assist in properly positioning cutter cone assembly 290 on spindle 216. First diameter portion 138 of spindle 216 is sized to contact both bushing 156 and a portion of cavity 214 disposed between ball race 134 and recess 254. Second outside diameter portion 140 of spindle 216 is preferably sized to contact a portion of cavity 214 disposed adjacent thereto. For some applications, the bearing clearances or running clearances associated with bushing 156 and first outside diameter portion 138 are slightly closer together as compared with the running clearances between second outside diameter portion 14 and adjacent portions of cavity 214.

For the embodiment of the present invention shown in FIG. 5, cutter cone assembly 390 includes an enlarged inside diameter portion 354 which extends from seal ring 118 to ball race 134. For this embodiment of the present invention, enlarged bushing 356 may be disposed between first outside diameter portion 138 and inside diameter 354 of cavity 314.

For the embodiment of the present invention shown in FIG. 6, cutter cone assembly 490 has been further modified by forming an enlarged inside diameter portion 358 which extends from ball race 134 toward shoulder 158. For this embodiment of the present invention, bushing 357 may be disposed between second outside diameter portion 140 of spindle 216 and inside diameter 358 of cavity 314. Cooperation between bushings 356 and 357 as shown in FIG. 6, will further enhance the rotational stability of cutter cone assembly 490 on spindle 216.

Shirttail 106 may be defined as the junction between exterior surface 104 and inside surface 105 of support arm 88. For the embodiment of the present invention as shown in FIGS. 2 and 3, shirttail 106 will preferably have a radius of curvature corresponding approximately with adjacent portions of cutter cone assembly 90. Shirttail 50 of support arm 32 has a similar radius of curvatures. For purposes of the present patent application, the term "shirttail portion" is used to describe the portion of exterior surface 104 of support arm 80 extending from opening 110 toward shirttail 106. For drill bit 20, the shirttail portion is generally defined as the portion of exterior surface 34 extending from opening 48 to shirttail 50.

For purposes of the present application, the term "hardfacing" is used to refer to a layer of material which has been applied to a substrate to protect the substrate from abrasion, erosion and/or wear. Various binders such as cobalt, nickel, copper, iron and alloys thereof may be used to form the matrix or binder portion of the deposit. Various metal alloys, ceramic alloys and cermets such as metal borides, metal carbides, metal oxides and metal nitrides may be included as part of the matrix deposit in accordance with the teachings of the present invention. Some of the more beneficial metal alloys, ceramic alloys and cermets will be discussed later in more detail. Hardfacing may also be referred to as a "matrix deposit."

For purpose of the present application, the term "tungsten carbide" includes monotungsten carbide (WC), ditungsten carbide ($W_2C$), macrocrystalline tungsten carbide and cemented or sintered tungsten carbide. Sintered tungsten carbide is typically made from a mixture of tungsten carbide and cobalt powders by pressing the powder mixture to form a green compact. Various cobalt alloy powders may also be included.

Hardfacing layer 108 may be satisfactorily formed using hard ceramic particles and/or hard particles formed from superabrasive and superhard materials commonly found as phases in the boron-carbon-nitrogen-silicon family of compounds and alloys. Examples of materials that may be satisfactorily used to form hardfacing layer 108 include diamonds, silicon nitride ($Si_3N_4$), silicon carbide (SiC), boron carbide ($B_4C$) in addition to cubic boron nitride (CBN). Various materials including cobalt, copper, nickel, iron, and alloys of these elements may also be used to form hardfacing layer 108. For example, metal borides, metal carbides, metal oxides and metal nitrides or other superhard and superabrasive materials may be used to form all or a portion of hardfacing layer 108. Depending upon the intended application for hardfacing layer 108, various types of tungsten carbide may be used to form all or a portion thereof.

A wide variety of hardfacing materials have been satisfactorily used on drill bits and other downhole tools. A frequently used hardfacing includes sintered tungsten carbide particles in an alloy steel matrix deposit. Other forms of tungsten carbide particles may include grains of monotungsten carbide, ditungsten carbide and/or macrocrystalline tungsten carbide. Satisfactory binders may include materials such as cobalt, iron, nickel, alloys of iron and other metallic alloys. For some applications, loose hardfacing material is generally placed in a hollow tube or welding rod and applied to the substrate using conventional welding techniques. As a result of the welding process, a matrix deposit including both steel alloy melted from the substrate surface and steel alloy provided by the welding rod or hollow tube is formed with the hardfacing. Various alloys of cobalt, nickel and/or steel may be used as part of the binder for the matrix deposit. Other heavy metal carbides and nitrides, in addition to tungsten carbide, have been used to form hardfacing.

ADDITIONAL COMMENTS

The basic embodiment of the invention consists of a somewhat conventional roller cone bit bearing arrangement with exception to the fit and function of the arm bearing thrust flange and the relative position of the ball bearings.

The invention optimizes the axial location of the ball bearing races to provide maximum radial and thrust capacity of the bearing system. This configuration provides sufficient radial surface area to the arm thrust flange to serve as a supplemental contact surface of the primary journal bearing.

The invention may also apply to alternate bearing configurations that use a wide variety of devices other than ball bearings to retain a cutter cone assembly on a spindle.

Most roller cone drill bits in sizes of up to about 12¼ inches in diameter typically feature a "friction-ball-friction" bearing geometry. The cylindrical friction surfaces bear the radial loads imposed on the bit, while the ball bearings resist the in-thrust forces.

Convention has normally been to locate the arm ball race some minimum essential distance from the thrust flange to provide the greatest possible spread between the ball bearing and the seal. This expanse defines the sole contact area of the primary journal bearing. Since the cylindrical surface area of the relatively thin thrust flange is insufficient to act as a load bearing surface, radial clearance is provided in this region.

The secondary journal bearing is proportioned to fit within the balance of the available envelope.

Running clearances of the primary journal bearing are generally slightly closer than those of the secondary journal to ensure the smaller member is not overloaded.

The new invention provides an improvement by positioning the ball bearing closer to the seal, thereby sufficiently increasing the cylindrical area of the arm thrust flange to serve as a radial load bearing surface. This increases the total surface area of the primary journal bearing as compared to prior art designs. Moreover, the effective spread of the primary journal is appreciatively enhanced to improve bearing stability while encountering overturning loads. This added rigidity decreases angular misalignment, while reducing the bending stresses in the secondary journal.

Although the present invention has been described by several embodiments, various changes and modifications may be suggested to one skilled in the art. It is intended that the present invention encompasses such changes and modifications as fall within the scope of the present appended claims.

What is claimed is:

1. A rotary cone drill bit having a bit body with an upper portion adapted for connection to a drill string for rotation of the drill bit to form a borehole, comprising:

a number of support arms attached to and extending from the bit body opposite the upper portion, each of the support arms having an inside surface with a respective spindle connected thereto;

each spindle projecting generally downwardly and inwardly with respect to its associated support arm;

a number of cutter cone assemblies equal to the number of support arms, with each cutter cone assembly having a cavity therein which allows said cutter cone assembly to be rotatably mounted on a respective spindle;

a first outside diameter portion and a second outside diameter portion formed on the exterior of each spindle with the first outside diameter portion and the second outside diameter portion formed generally concentric with the axis of the respective spindle;

an opening formed in an exterior surface of each support arm with a ball retaining passageway extending from the opening in the exterior of the support arm to a location between the first outside diameter portion and the second outside diameter portions of the associated spindle whereby ball bearings may be inserted through the opening and the ball retaining passageway to rotatably secure each cutter cone assembly on its respective spindle;

the first outside diameter portion of each spindle providing at least one component of a radial bearing disposed between the spindle and the cavity;

the second outside diameter portion of the spindle providing at least one component of a second radial bearing disposed between the exterior of the spindle and adjacent portions of the cavity;

the first outside diameter portion having approximately the same diameter as the second outside diameter portion; and an opening from the ball retaining passageway disposed between the first outside diameter portion of the spindle and the second outside diameter portion of the spindle.

2. The drill bit of claim 1 further comprising:

the first outside diameter portion of the spindle disposed adjacent to the inside surface of the associated support arm; and the second outside diameter portion of the spindle disposed adjacent to a shoulder formed on the exterior of this spindle.

3. The drill bit of claim 2 wherein the shoulder comprises at least one component of a thrust bearing disposed between the spindle and adjacent portions of the cavity.

4. The drill bit of claim 1, wherein said second outside diameter portion has a length which is at least 25% of the length of said first outside diameter portion.

5. The drill bit of claim 1 wherein each support arm further comprises:

each of the support arms having a leading edge, a trailing edge, and an exterior surface disposed therebetween;

a ball plug weld disposed within the opening to form a fluid barrier between the ball retainer passageway and the exterior surface of the respective support arm;

the exterior surface of each support arm having a shirttail portion; and a layer of hardfacing material disposed on the shirttail portion.

6. The drill bit of claim 5 wherein each support arm further comprises a plurality of inserts disposed in the exterior surface of each support arm.

7. The drill bit of claim 5 wherein the hardfacing material is selected from the group consisting of metal borides, metal carbides, metal oxides and metal nitrides.

8. The drill bit of claim 5 wherein the layer of hardfacing is formed at least in part from materials selected from the group consisting of boron, carbon, copper, nickel, iron, cobalt, carbides, nitrides, borides, silicides and oxides of tungsten, niobium, vanadium molybdenum, titanium, tantalum, hafnium, yttrium, zirconium, chromium, and mixtures thereof.

9. The drill bit of claim 1 further comprising each spindle having an axis extending therethrough which corresponds generally with the axis of rotation for the associated cutter cone assembly.

10. The drill bit of claim 1 further comprising:

a third outside diameter portion formed on the exterior of each spindle with the third outside diameter portion located adjacent to one end of the spindle opposite from the support arm; and a shoulder formed on the exterior of the spindle between the second outside diameter portion and the third diameter portion.

11. The drill bit of claim 1 further comprising a shoulder formed on the exterior of each spindle providing at least one component of a thrust bearing disposed between the spindle and the cavity.

12. The drill bit of claim 1 further comprising:

each spindle having an end opposite from the respective support arm; and the end of each spindle providing at least one component of a thrust bearing disposed between the spindle and the cavity.

13. The drill bit of claim 1 further comprising:

the cavity of each cutter cone assembly having an opening with a seal ring disposed within the respective cavity adjacent to the opening; and an enlarged outside diameter formed on the exterior of each spindle between the respective first outside diameter portion and the inside surface of the respective support arm, whereby the enlarged outside diameter portion and the seal ring cooperate with each other to form a fluid barrier between the cavity and the exterior of the cutter cone assembly.

14. A rotating cone drill bit, comprising:

a journal having first, second and third journal bearing surfaces all supporting a common rotating cone, said first and second journal bearing surfaces having substantially equal diameters, said third journal bearing surface having a smaller diameter than said first and second journal bearing surfaces;

wherein said first and said second journal bearing surfaces are separated by a region which is not a journal bearing surface.

15. A rotating cone drill bit, comprising:

a journal having first, second and third journal bearing surfaces, said first and second journal bearing surfaces having substantially equal diameters, said third journal bearing surface having a smaller diameter than said first and second journal bearing surfaces;

wherein said first and second journal bearing surfaces are separated by a ball race for ball bearings, which is not a journal bearing surface.

16. A rotary cone drill bit, comprising:

a cone portion which rotates around a bearing, said bearing comprising:

a first journal bearing portion adjacent a sealing ring;

a retention portion adjacent said first journal bearing;

a second journal bearing on a side of said retention portion opposite said first journal bearing;

said first and second journal bearings have substantially equal diameters;

said second journal bearing having an axial length which is at least twenty-five percent the axial length of said first journal bearing.

17. The rotating cone drill bit of claim 16, wherein said first and second journal bearing surfaces are separated by a ball race for ball bearings.

* * * * *